US006913065B2

(12) United States Patent
Kneppe et al.

(10) Patent No.: US 6,913,065 B2
(45) **Date of Patent: *Jul. 5, 2005**

(54) DEVICE FOR CONTINUOUSLY CASTING METALS, ESPECIALLY STEEL

(75) Inventors: Günter Kneppe, Hilchenbach (DE); Joachim Schwellenbach, Düsseldorf (DE); Hans Streubel, Erkrath (DE)

(73) Assignee: SMS Demag AG, Düsseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/344,824

(22) PCT Filed: Jul. 25, 2001

(86) PCT No.: PCT/EP01/08572

§ 371 (c)(1),
(2), (4) Date: Jun. 19, 2003

(87) PCT Pub. No.: WO02/13994

PCT Pub. Date: Feb. 21, 2002

(65) Prior Publication Data

US 2004/0026065 A1 Feb. 12, 2004

(30) Foreign Application Priority Data

Aug. 17, 2000 (DE) ..... 100 40 271

(51) Int. Cl.[7] ..... B22D 11/128
(52) U.S. Cl. ..... 164/442; 164/448
(58) Field of Search ..... 164/441–442, 164/447–448

(56) References Cited

U.S. PATENT DOCUMENTS 5,348,074 A 9/1994 Streubel
6,568,460 B1 * 5/2003 Kneppe et al. ..... 164/442

FOREIGN PATENT DOCUMENTS

DE 4022871 1/1992
EP 0941787 9/1999

* cited by examiner

*Primary Examiner*—Kuang Y. Lin
(74) *Attorney, Agent, or Firm*—Friedrich Kueffner

(57) ABSTRACT

A device for continuously casting metals, especially steel, consists of multipleconsecutive segments (1) which each form the strand guide for casting strands of different widths (4), with roller pairs (2). The rollers are rotationally mounted on segment frames (5; 6), these segment frames (5; 6) each being braced with strand guide frames (10) on both sides. The aim of the invention is to reduce profile increases in the cross-section of the casting strand (4*d*) in the residual solidification area (4*b*), by providing a power mechanism (13) at least on the fixed side of the segment frame (5) of a segment (1), between the segment frame (5) and a transversal member (11) connecting the strand guide frames (10) on the two sides. Said power mechanism is situated approximately on the middle strand axis. The power transmission element (13*a*) of the power mechanism acts upon the segment frame (5), while its base (13*b*) is supported on the transversal member (11).

10 Claims, 1 Drawing Sheet

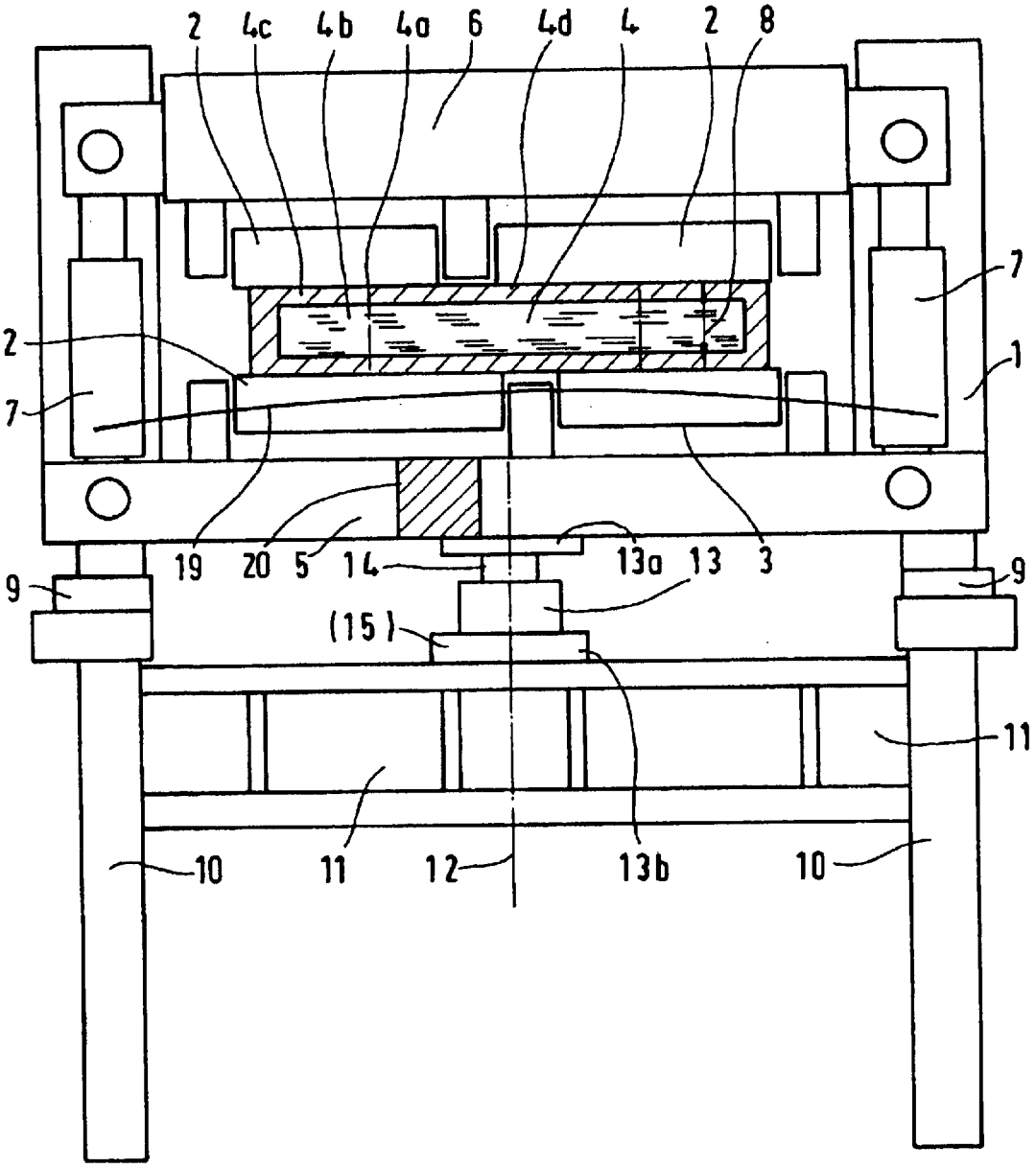
2
4c
4b
4a
6
4d
4
2
8
7
2
1
7
19
20
5
14
13a
13
3
9
9
(15)
11
11
10
12
13b
10

DEVICE FOR CONTINUOUSLY CASTING METALS, ESPECIALLY STEEL

BACKGROUND OF INVENTION invention pertains to a device for continuously casting metals, especially steel, with several successive segments, each of which has a pair of rolls, consisting of an upper and a lower roll, the segments forming a strand guide for cast strands of different widths, where the rolls are rotatably supported on tie-bars of a segment frame, and where each of the tie-bars is braced on both sides by strand guide frames.

Devices of this type are known, for example, as guides for thin metal strip (EP 0 941 787 A1). In this case, however, an adjusting device for adjusting the crown bow of the roll gap is provided for a pair of guide rolls, which forms a roll gap. A device of this type cannot be used to solve other problems.

The profile of a cast slab in the residual solidification area of the cast strand is essentially an image of the geometry of the roll gap. Different strand widths and casting speeds lead to different roll deflections and to different deflections of the tie-bars of the segment frame and thus to a slab profile with a variable camber.

In the area of the soft reducing section, the deflections of the rolls and tie-bars are determined by the location of the tip of the crater, by the thickness reduction setting, and by the grade of steel. It also happens that, in the case of slab systems with a lengthwise cutting device (single or multiple lengthwise cutting), the lengths of cut slab which are sent to the rolling mill will have various wedge-like shapes because of the camber of the original slab. These variable shapes lead to problems in the mill when a very thin strip is to be obtained as the end product.

SUMMARY OF THE INVENTION

The invention is based on the task of decreasing this variable camber in the final solidification area, so that the problem described above during the following rolling process will no longer occur.

Proceeding from the device described above, the indicated task is accomplished according to the invention in that a force-exerting mechanism, located approximately on the center axis of the strand, is provided at least on the fixed side of the segment frame, between the segment frame and a transverse tie-bar, which connects the two strand guide frames. The force-transmitting element of this force mechanism acts on the segment frame and is supported at the other end on the transverse tie-bar. Because the rolls can thus be made to flex, it is possible to reduce the camber of the profile by bending the segment tie-bar in the opposite direction. The profile camber of the cast strand required for rolling can thus be obtained. Depending on where the tip of the crater is, it is also possible to use the force mechanism to influence the deflections of the roll and of the tie-bar as a function of the load on the segment in such a way that the resulting camber of the profile does not lead to any problems in the rolling mill even in cases where the slabs are cut lengthwise.

The force mechanism can consist of a single-acting plunger.

In another embodiment, the force mechanism consists of a double-acting, hydraulic piston-cylinder unit.

In accordance with additional features, it is proposed that the force exerted by the force mechanism can be controlled automatically as a function of the load being exerted on the segment by the cast strand. As a result, it is possible to prevent excessive loads from acting on the segment frame.

This automatic control can also be implemented in that, as a function of the load being exerted on the segment, the force exerted by the force mechanism can be transmitted to the deflection of the support roll and the tie-bar to oppose the expected camber of the cross section of the cast strand.

It can also be advantageous in certain situations for the force exerted by the force mechanism to be adjustable force on the floating side of the segment. The advantages which can be achieved will be the same as or similar to those obtained when the force mechanism is located on the fixed side of the segment.

Another application of the basic idea of the invention consists in that the force exerted by the force mechanism can be adjusted simultaneously on the fixed side and on the floating side of the two opposing segment frames.

It can also be advantageous to assign several force mechanisms to each segment frame. As a result, the curvature of the tie-bar can be adjusted more exactly.

It is conventional in practice to install a lengthwise cutting device downstream from the segments. Adjusting the profile camber just upstream of the lengthwise cutting device means that the profile can be adjusted precisely to the shape required for rolling before the slab is cut.

A special embodiment, furthermore, consists in that the characteristic curves which describe the deformation of a segment are filed in the form of tables in a computer, and that the force exerted by the force mechanism can be called up from the stored values in correspondence with the load being exerted on the segments. As a result, it is easy to use both empirical values and values based on the design dimensions to calculate the most suitable curvature.

BRIEF DESCRIPTION OF DRAWING

The single FIGURE of the drawing shows a front view of a support roll segment, that is, a view perpendicular to the direction in which the cast strand is traveling, as will be explained below in greater detail.

DETAIL DESCRIPTION OF THE DRAWING

The device for the continuous casting of metals, especially of steel, consists of several segments 1, which succeed each other in the direction of travel of the strand. To guide the cast strand 4, each segment has a pair 2 of rolls, which can consist of split rolls 3, comprising an upper and a lower roll. The width 4*a* of the cast strand 4 can vary. To indicate the point at which the position of the segment 1 is located, the cast strand 4 has a strand shell 4*c* in the area of residual solidification 4*b*. The two rolls of the pair 2 are rotatably supported on segment frames 5, 6; the segment frame 5 is on the fixed side, whereas the segment frame 6 is on the floating side. The two segment frames 5 and 6 can be moved toward each other by means of traction cylinders 7 so as to take into account the thickness 8 of the cast strand 4. The segment 1, consisting of the segment frames 5 and 6 and the traction cylinders 7, is attached on both sides by means of clamping cylinders 9 (not illustrated in detail) to the strand guide frames 10.

At least one force-exerting mechanism 13 is provided approximately on the center axis 12 of the strand, this mechanism being installed at least on the side of the segment 1 with the fixed segment frame 5, i.e., between the segment frame 5 and a transverse tie-bar 11, possibly added for the purpose, which connects the two strand guide frames 10. The force-transmitting element 13*a* of this force-exerting mechanism acts on the segment frame 5, and the base 13*b* of the mechanism is supported on the transverse tie-bar 11. The segment 1 and the transverse tie-bar 11 are provided at least in the area of the residual solidification 4*b*. The force mechanism 13 can consist of a single-acting plunger 14 or of a double-acting, hydraulic piston-cylinder unit 15.

The force exerted by the force mechanism 13 can be controlled automatically as a function of the load being exerted on the segment by the cast strand 4. The force exerted by the force mechanism 13 can also be made adjustable on the floating side 6 of the segment 1. In special cases, it can be advantageous for the force exerted by the force mechanism 13 to be adjustable simultaneously on both the fixed side 5 and the floating side 6 of two opposite segment frames 5, 6.

Several force mechanisms 13 can be assigned to each of the segment frames 5, 6.

A lengthwise cutting device of conventional design follows the segment 1 with the transverse tie-bar 11 and the force-exerting mechanism 13.

The characteristic deformation curve 19 of a segment 1 is filed in the form of tables in a computer, and the force to be exerted by the force mechanism 13 can be called up from the stored values in correspondence with the load being exerted on the segment.

The cross section 20 of the transverse tie-bar of the segment 1 is to be selected as a function of the load exerted on the segment to minimize the force which must be exerted by the force mechanism 13.

List of Reference Numbers

1 segment
2 pair of rolls
3 split roll
4 cast strand
4*a* variable width
4*b* residual solidification area
4*c* strand shell
4*d* cross section of the cast strand
5 segment frame, fixed side
6 segment frame, floating side
7 traction cylinder
8 thickness of the cast strand
9 clamping cylinder
10 strand guide frame, one on each side
11 transverse tie-bar
12 center axis of the strand
13 force-exerting mechanism
13*a* force-transmitting element
13*b* base
14 plunger
15 piston-cylinder unit
19 characteristic deformation curve
20 cross section of the tie-bar

What is claimed is:

1. Device for the continuous casting of metals, especially of steel, comprising several successive segments, each of which has a pair of rolls, consisting of an upper and a lower roll, the segments forming a strand guide for cast strands of different widths, where the rolls are rotatably supported on the tie-bars of a segment frame, and where each of the tie-bars is braced on both sides by strand guide frames, wherein, at least on fixed side of the segment frame (5), a force-exerting mechanism (13), lying approximately on the center axis (12) of the strand, is provided between the segment frame (5) and a transverse tie-bar (11), which connects the two strand guide frames (10), the force-transmitting element (13*a*) of the force-exerting mechanism acting on the segment frame (5), whereas the base (13*b*) of the force mechanism is supported on the transverse tie-bar (11).

2. Device according to claim 1, wherein the force-exerting mechanism (13) consists of a single-acting plunger (14).

3. Device according to claim 1, wherein the force-exerting mechanism (13) consists of a double-acting, hydraulic piston-cylinder unit (15).

4. Device according to claim 1, wherein the force exerted by the force mechanism (13) can be automatically controlled as a function of the load being exerted on the segment by the cast strand (4).

5. Device according to claim 4, wherein, as a function of the load on the segment, the force being exerted by the force mechanism (13) can be transmitted to the deflections of the support roll and the tie-bar to oppose the expected profile camber of the cross section of Ehe strand (4*d*).

6. Device according to claim 1, wherein the force exerted by the force mechanism (13) is adjustable on the floating side (6) of the segment (1).

7. Device according to claim 1, wherein the force exerted by the force mechanism (13) is adjustable simultaneously on the fixed side (5) and on the loose side (6) of the two opposing segment frames (5, 6).

8. Device according to claim 1, wherein several force-exerting mechanisms (13) are assigned to each segment frame (5, 6).

9. Device according to claim 1, wherein a lengthwise cutting device is installed downline from the segments (1).

10. Device according to claim 1, comprising a computer configured for filing the characteristic deformation curves (19) of a segment (1) in the form of tables, and for calling up the force to be exerted by the force mechanism (13) from stored values in correspondence with the load being exerted on the segments.

* * * * *